US006230449B1

(12) United States Patent
Colvin, Jr.

(10) Patent No.: US 6,230,449 B1
(45) Date of Patent: May 15, 2001

(54) SUPPORT ATTACHMENT FOR A POST

(76) Inventor: William A. Colvin, Jr., 5925 Park Cir., Ione, CA (US) 95640

( * ) Notice: Subject to any disclaimer, the term of this patent is extended or adjusted under 35 U.S.C. 154(b) by 0 days.

(21) Appl. No.: 09/335,166

(22) Filed: Jun. 17, 1999

(51) Int. Cl.[7] ..... E02D 5/74
(52) U.S. Cl. ..... 52/164; 52/166; 52/170
(58) Field of Search ..... 52/170, 153, 164, 52/155, 166

(56) References Cited

U.S. PATENT DOCUMENTS 2,279,918 * 4/1942 Fee et al. ..... 52/170
3,295,275 * 1/1967 Carlsen ..... 52/170
4,543,757 * 10/1985 Cosgrove ..... 52/166 X
5,203,817 * 4/1993 Klulmpjan ..... 52/170 X
5,636,482 * 6/1997 Klager ..... 52/170 X
5,867,953 * 2/1999 Amundsen ..... 52/170

* cited by examiner

*Primary Examiner*—David M. Purol

(57) ABSTRACT

A support attachment for a post for reinforcing posts and straightening leaning posts. The support attachment for a post includes a generally L-shaped angle member for coupling to the post towards the lower end of the post. A pair of first arms are coupled to a lower end of the angle member for coupling, and a pair of second arms are pivotally coupled to free ends of the first arms.

11 Claims, 3 Drawing Sheets

SUPPORT ATTACHMENT FOR A POST

BACKGROUND OF THE INVENTION

1. Field of the Invention

The present invention relates to post supports and more particularly pertains to a new support attachment for a post for reinforcing posts and straightening leaning posts.

2. Description of the Prior Art

The use of post supports is known in the prior art. More specifically, post supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,296,584; 5,011,107; 4,593,872; 4,923,164; 5,135,192; and 354,792.

While these devices fulfill their respective, particular objectives and requirements, the aforementioned patents do not disclose a new support attachment for a post. The inventive device includes a generally L-shaped angle iron coupled to the post towards the lower end of the post. A pair of first arms are coupled to a lower end of the angle iron, and a pair of second arms are pivotally coupled to free ends of the first arms.

In these respects, the support attachment for a post according to the present invention substantially departs from the conventional concepts and designs of the prior art, and in so doing provides an apparatus primarily developed for the purpose of reinforcing posts and straightening leaning posts.

SUMMARY OF THE INVENTION

In view of the foregoing disadvantages inherent in the known types of post supports now present in the prior art, the present invention provides a new support attachment for a post construction wherein the same can be utilized for reinforcing posts and straightening leaning posts.

The general purpose of the present invention, which will be described subsequently in greater detail, is to provide a new support attachment for a post apparatus and method which has many of the advantages of the post supports mentioned heretofore and many novel features that result in a new support attachment for a post which is not anticipated, rendered obvious, suggested, or even implied by any of the prior art post supports, either alone or in any combination thereof.

To attain this, the present invention generally comprises a generally L-shaped angle iron coupled to the post towards the lower end of the post. A pair of first arms are coupled to a lower end of the angle iron, and a pair of second arms are pivotally coupled to free ends of the first arms.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new support attachment for a post apparatus and method which has many of the advantages of the post supports mentioned heretofore and many novel features that result in a new support attachment for a post which is not anticipated, rendered obvious, suggested, or even implied by any of the prior art post supports, either alone or in any combination thereof.

It is another object of the present invention to provide a new support attachment for a post which may be easily and efficiently manufactured and marketed.

It is a further object of the present invention to provide a new support attachment for a post which is of a durable and reliable construction.

An even further object of the present invention is to provide a new support attachment for a post which is susceptible of a low cost of manufacture with regard to both materials and labor, and which accordingly is then susceptible of low prices of sale to the consuming public, thereby making such support attachment for a post economically available to the buying public.

Still yet another object of the present invention is to provide a new support attachment for a post which provides in the apparatuses and methods of the prior art some of the advantages thereof, while simultaneously overcoming some of the disadvantages normally associated therewith.

Still another object of the present invention is to provide a new support attachment for a post for reinforcing posts and straightening leaning posts.

Yet another object of the present invention is to provide a new support attachment for a post which includes a generally L-shaped angle iron coupled to the post towards the lower end of the post. A pair of first arms are coupled to a lower end of the angle iron, and a pair of second arms are pivotally coupled to free ends of the first arms.

Still yet another object of the present invention is to provide a new support attachment for a post that can be used to straighten a leaning fence post without removing the post from the ground. The attachment is merely coupled to the post and buried in packed dirt or concrete beside the post.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
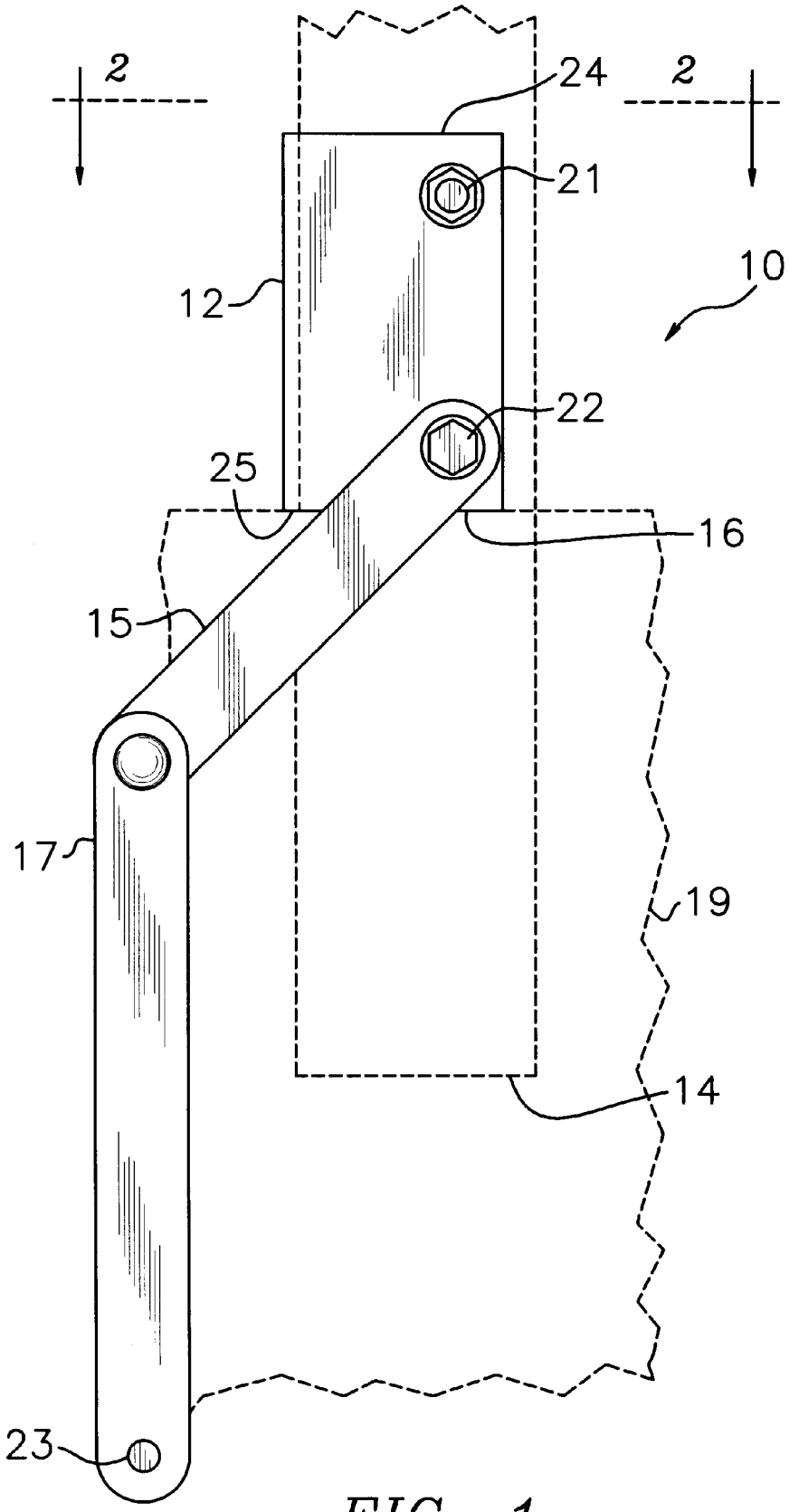
FIG. 1 is a schematic side view of a new support attachment for a post according to the present invention.
Figure 2:
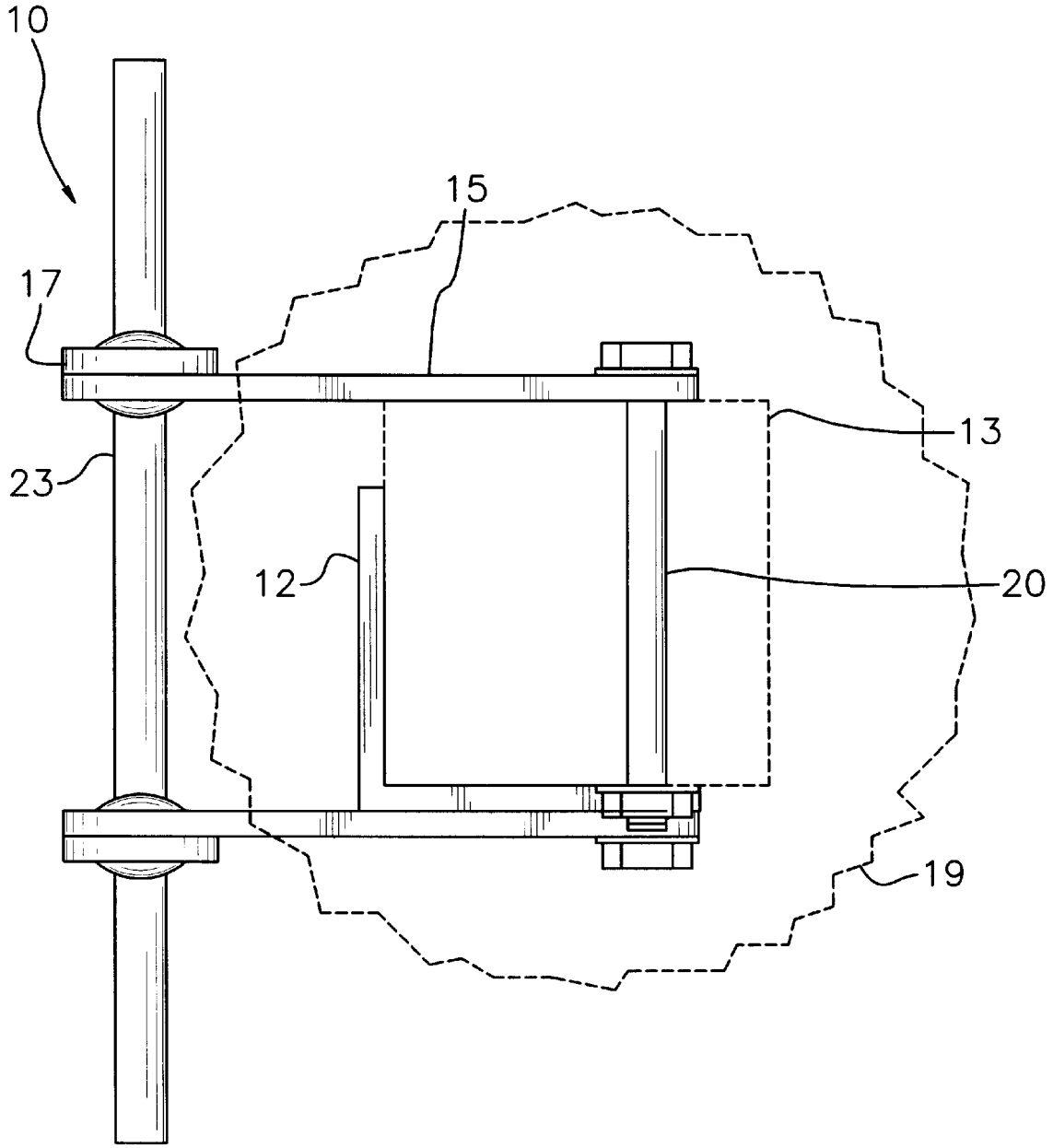
FIG. 2 is a schematic side view of the present invention.
Figure 3:
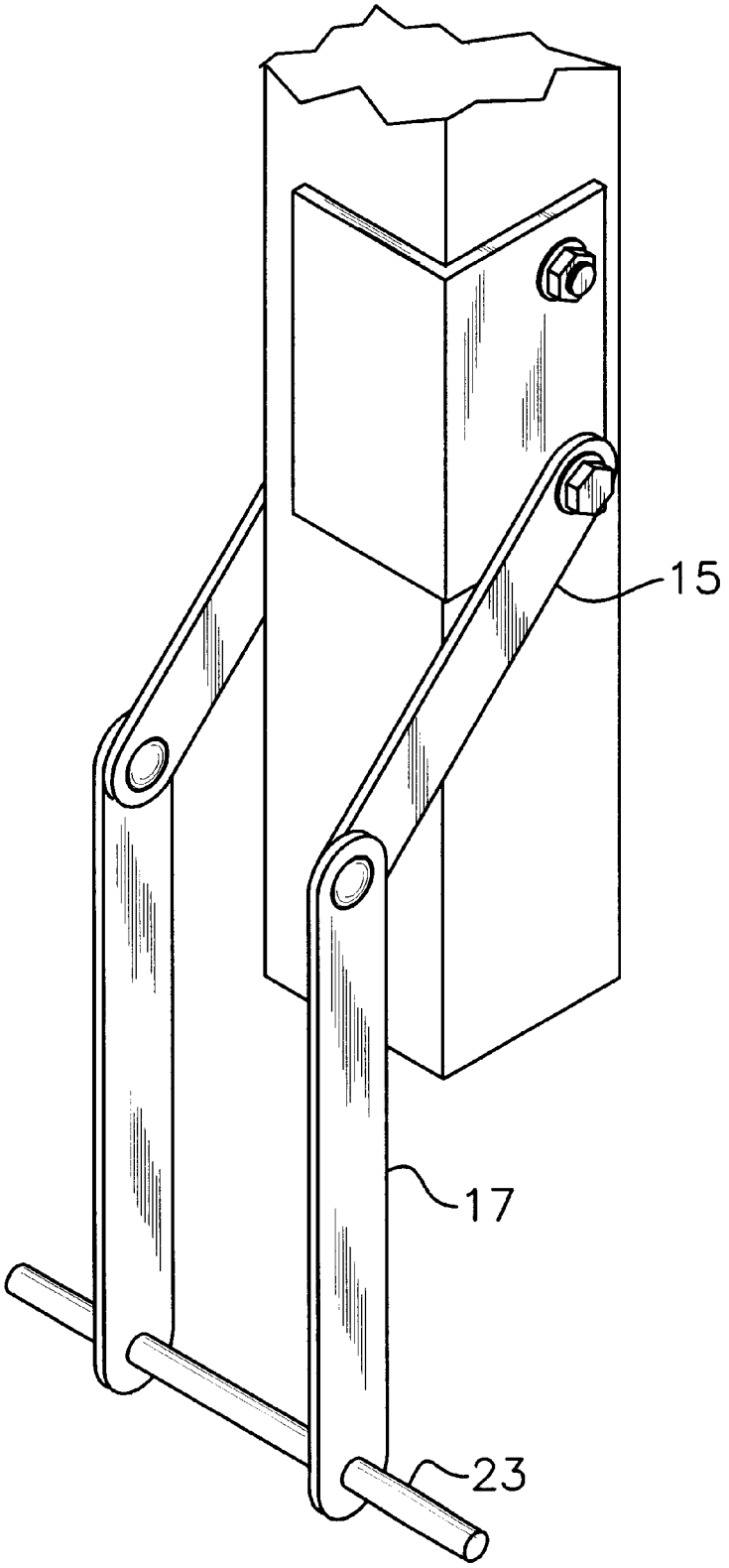
FIG. 3 is a schematic perspective view of the present invention.

With reference now to the drawings, and in particular to FIGS. 1 through 3 thereof, a new support attachment for a post embodying the principles and concepts of the present invention and generally designated by the reference numeral 10 will be described.

As best illustrated in FIGS. 1 through 3, the support attachment for a post 10 generally comprises a generally L-shaped angle iron 12 coupled to the post 13 towards the lower end 14 of the post. A pair of first arms 15 are coupled to a lower end 16 of the angle iron, and a pair of second arms 17 are pivotally coupled to free ends of the first arms.

The elongate post may be of a type having opposite upper and lower ends and a longitudinal axis extending between the ends. The lower end is secured in a ground surface by a first quantity of concrete 19.

Preferably, the post has a generally rectangular transverse cross section taken perpendicular to the longitudinal axis thereof. The post has a pair of generally vertically aligned apertures 20 therethrough positioned above the ground surface.

A generally L-shaped angle iron is coupled to the post towards the lower end of the post. Preferably, the angle iron has a pair of vertically aligned holes therethrough that are aligned with the apertures of the post.

A first threaded fastener 21 extends through a first of the holes and through a first of the apertures of the post for coupling the angle iron to the post.

Preferably, each of the first arms has proximal and distal apertures positioned towards opposite ends thereof. The proximal aperture of one of the first arms is positioned towards and aligned with a second of the holes of the angle iron. The proximal aperture of the other of the first arms is positioned towards a second of the apertures of the post such that the post is interposed between the first arms.

A second threaded fastener 22 extends through the proximal apertures of the first arms and the post for coupling the first arms and the angle iron to the post.

Preferably, the pair of second arms are pivotally coupled to free ends of the first arms by a bolt, nut and washer.

Also preferably, a horizontal support bar 23 extends through lower ends of the second arms.

The preferred height of the angle iron is between about 6 and 10 inches, ideally about 8 inches between its upper and lower edges 24, 25. This range of heights has been found to provide sufficient support to the post. The holes of the angle iron are preferably positioned between about 1 and 3 inches, ideally about 2 inches, from the upper edge of the angle iron. This range provides sufficient distance between the holes and the upper and lower edges of the angle iron so that the post will not break off when an outside force is brought to bear on the post.

The preferred length of each of the first arms is between about 6 and 12 inches, ideally about 9 inches, between its opposite ends. This range provides sufficient distance from the angle iron that the post may be based in a first portion of concrete and the second arms buried in the ground or another portion of concrete adjacent the first portion of concrete.

The preferred length of each of the second arms is between about 6 and 12 inches, ideally about 9 inches, between its opposite ends. This range provides sufficient depth to anchor the post without risk of pulling up the horizontal support bar.

The preferred length of the horizontal support bar is greater than at least 6 inches. A support bar of at least 6 inches is required to prevent the support bar from is pulled out of soil when an outside force is brought to bear on the post.

In use, the angle iron and first arms are attached to the post. The second arms are buried in the ground or in concrete adjacent the post. Any movement of the post would require the second arms to displace soil or concrete surrounding it. The horizontal support bar increases the amount of soil or concrete that must be displaced to move the post.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A post support system, comprising:

a post having a lower end for positioning in the ground;

a generally L-shaped angle coupled to said post towards said a lower end of said post;

a pair of first arms coupled to a lower end of said angle member, each of said first arms being positioned on a side of said post opposite of the other first arm;

a pair of second arms being pivotally coupled to free ends of said first arms, said second arms being extendable adjacent and parallel to said lower end of said post for burial in said ground at locations adjacent to said lower end of said post; and a horizontal support bar extending between lower ends of said second arms for extending across the lower end of said post.

2. The post support system of claim 1, wherein said post has a plurality of apertures, said angle member having a pair of holes therethrough being aligned with apertures of said post, a first fastener extending through a first of said holes and through a first of said apertures of said post for coupling said angle member to said post.

3. The post support system of claim 2, wherein said first arms each has proximal and distal apertures positioned towards opposite ends thereof, said proximal aperture of one of said first arms being positioned towards and aligned with a second of said holes of said angle member, said proximal aperture of the other of said first arms being positioned towards a second of said apertures of said post such that said post is interposed between said first arms, a second threaded fastener extending through said proximal apertures of said first arms and said post for coupling said first arms and said angle member to said post.

4. The post support system of claim 1, wherein said second arms are pivotally coupled to said first arms by a bolt, nut and washer.

5. The post support system of claim 1, wherein the angle member comprises a height between about 6 and 10 inches between its upper and lower edges for providing sufficient support to the post.

6. The post system of claim 2, wherein the holes of the angle member are positioned between about 1 and 3 inches from the upper edge of the angle member for providing sufficient distance between the holes and the upper and lower edges of the angle iron so that the post will not break off when an outside force is brought to bear on the post.

7. The post support system of claim 1, wherein a length of each of the first arms is between about 6 and 12 inches between its opposite ends for providing sufficient distance from the first arms to the angle iron such that the post may be based in a first portion of concrete and the second arms buried in the ground or another portion of concrete adjacent the first portion of concrete.

8. The post support system of claim 1, wherein a length of each of the second arms is between about 6 and 12 inches between its opposite ends for providing sufficient depth to anchor the post without risk of pulling up the horizontal support bar.

9. The post support system of claim 1, wherein a length of the horizontal support bar is greater than at least 6 inches for preventing the support bar from being pulled out of soil when an outside force is brought to bear on the post.

10. A post with support attachment, comprising:

an elongate post having opposite upper and lower ends and a longitudinal axis extending between said ends, said lower end being secured in a ground surface;

wherein said post has a generally rectangular transverse cross section taken perpendicular to said longitudinal axis thereof;

said post having a pair of generally vertically aligned apertures therethrough positioned above said ground surface;

a generally L-shaped angle iron coupled to said post towards said lower end of said post;

said angle iron having a pair of vertically aligned holes therethrough being aligned with said apertures of said post;

a first threaded fastener extending through a first of said holes and through a first of said apertures of said post for coupling said angle iron to said post;

a pair of first arms each having proximal and distal apertures positioned towards opposite ends thereof, said proximal aperture of one of said first arms being positioned towards and aligned with a second of said holes of said angle iron, said proximal aperture of the other of said first arms being positioned towards a second of said apertures of said post such that said post is interposed between said first arms;

a second threaded fastener extending through said proximal apertures of said first arms and said post for coupling said first arms to said post;

a pair of second arms being pivotally coupled to free ends of said first arms; and a horizontal support bar extending through lower ends of said second arms.

11. A post support attachment system comprising:

a post having an elongate shape and opposite upper and lower ends and a longitudinal axis extending between the ends, with the lower end of the post being secured in a ground surface, wherein the post has a generally rectangular transverse cross section taken perpendicular to the longitudinal axis thereof and the post has a pair of generally vertically aligned apertures therethrough positioned above the ground surface; and a support attachment comprising:

a generally L-shaped angle member for coupling to a post towards said lower end of said post;

said angle member having a pair of vertically aligned holes therethrough being aligned with said apertures of said post;

a first threaded fastener for extending through a first of said holes and for extending through a first of said apertures of said post for coupling said angle member to said post;

a pair of first arms each having proximal and distal apertures positioned towards opposite ends thereof, said proximal aperture of one of said first arms being positioned towards and aligned with a second of said holes of said angle member, said proximal aperture of the other of said first arms being positioned towards a second of said apertures of said post for permitting interposition of said post between said first arms;

a second threaded fastener for extending through said proximal apertures of said first arms and for extending through said post for coupling said first arms to said post;

a pair of second arms being pivotally coupled to free ends of said first arms; and a horizontal support bar extending between lower ends of said second arms.

* * * * *